United States Patent [19]

Galatha et al.

[11] Patent Number: 4,616,944

[45] Date of Patent: Oct. 14, 1986

[54] PRINTER FRAME ASSEMBLY AND METHOD OF ASSEMBLY

[75] Inventors: Matthew J. Galatha, Charlotte; David V. Iorio, Harrisburg; Carl W. Robinson, Charlotte, all of N.C.

[73] Assignee: International Business Machines Corporation, Armonk, N.Y.

[21] Appl. No.: 619,228

[22] Filed: Jun. 11, 1984

[51] Int. Cl.[4] ..... B41J 29/02

[52] U.S. Cl. ..... 400/692; 400/691

[58] Field of Search ..... 400/691–693.1, 400/660; 24/297, 573, 236–239, 23 EE, 30.5 S; 248/221.3, 221.4, 222.8; 312/257 A, 351, 208; 101/288

[56] References Cited

U.S. PATENT DOCUMENTS

| | | | |
|---|---|---|---|
| 3,017,972 | 1/1962 | Saxe | 248/221.3 |
| 3,075,627 | 1/1963 | Kuckhoff | 400/693.1 |
| 4,094,483 | 6/1978 | Busch | 248/221.4 |
| 4,323,807 | 4/1982 | Sugiura | 312/208 |
| 4,357,060 | 11/1982 | Kuhn | 400/691 |
| 4,418,618 | 12/1983 | Huggins et al. | 101/288 |
| 4,500,217 | 2/1985 | Swindler | 400/314 |

FOREIGN PATENT DOCUMENTS

| | | | |
|---|---|---|---|
| 2242569 | 3/1974 | Fed. Rep. of Germany . | |
| 7907011 | 7/1979 | Fed. Rep. of Germany . | |
| 3014284 | 10/1981 | Fed. Rep. of Germany . | |
| 92087 | 7/1981 | Japan | 400/691 |
| 160179 | 9/1983 | Japan | 400/692 |
| 166088 | 10/1983 | Japan | 400/693.1 |

OTHER PUBLICATIONS

Lentz et al, "Compressible Seal," IBM Technical Disclosure Bulletin, vol. 26, No. 3B, pp. 1662–1663, 8/83.

Galatha et al, "Snap-in . . . Mounting", IBM Technical Disclosure Bulletin, vol. 26, No. 6, p. 2702, 11/83.

Wilzbach, "Cover Latch" IBM Technical Disclosure Bulletin, vol. 24, No. 8, pp. 4151–4152, 1/82.

*Primary Examiner*—William Pieprz

*Attorney, Agent, or Firm*—E. R. Coffman; J. L. Abzug; S. J. Meyers

[57] ABSTRACT

A printer frame assembly having snap-together parts includes a base member, two side frame members, resilient cushions and an impact platen. The base member has locating receptacles to position the side frame members and interlocking flexure latches to snap-lock with corresponding locking surfaces located on the two side frame members. The interlocking flexure latches provide a bias to align the side frame members in a front-to-back direction and lateral alignment channels to prevent lateral displacement. The resilient cushions are positioned between the bottoms of the side frame members and the base member to urge the interlocking flexure latches and locking surfaces into secure engagement and to eliminate any clearances between the side frame members and the base member. The impact platen serves as a structural member of the frame and is positioned intermediate the two side frame members. The method of frame assembly comprises locating the resilient cushions on the base member, snapping the side frame members into respective locating receptacles and flexure latches of the base member, thereby trapping the resilient cushions, and locking the impact platen between the two side frame members.

6 Claims, 12 Drawing Figures

PRINTER FRAME ASSEMBLY AND METHOD OF ASSEMBLY

BACKGROUND OF THE INVENTION

1. Field of the Invention

This invention relates to a printer frame assembly and a method of assembling a printer frame having snap-together parts to facilitate assembly.

2. Description of the Prior Art

The assembly of complex mechanical apparatus such as a computer printer has traditionally been a very inefficient undertaking. Typically, a frame is assembled from several components. The printer mechanism is supported and fastened to the frame. Then the completed frame/printer mechanism is assembled onto a base. This form of assembly requires several complex assembly steps. Furthermore, small screws and other hardware are often used to secure such parts, components, and the like. The net result is an expensive, labor intensive, and time-consuming process.

It is desirable to have a printer frame assembly, having a minimum number of components, that can be precisely and accurately assembled with minimal manual intervention, i.e., by robotic assembly. Furthermore, this printer assembly must be strong, rigid, and accurate enough to support various interrelated moving parts of the printer mechanism. The printer assembly must also be durable and reliable enough to allow precise high-speed, high-quality printing for the long life expectancy of the printers.

SUMMARY OF THE INVENTION

It is a principal object of this invention to provide a printer frame assembly having snap-together parts that are readily assembled with robotic techniques.

It is a related object of this invention to provide a method of assembling a printer frame assembly which is conducive to robotic assembly techniques.

In accordance with these objects, a printer frame assembly is provided comprising a base member, two side frame members, resilient cushions and an impact platen. The base member has locating receptacles to position the side frame members and interlocking flexure latches to snap lock with corresponding locking surfaces located on the two side frame members. Furthermore, the interlocking flexure latches provide a bias to align the side frame members in a front-to-back direction and lateral alignment channels to maintain precise positioning of the assembled components. The resilient cushions are positioned between the bottoms of the side frame members and the base member to urge the interlocking flexure latches and locking surfaces into secure engagement and also to eliminate any clearances between the side frame members and the base member, thereby increasing the rigidity of the assembly. The impact platen, in addition to its function of providing support for the printing medium, serves as a structural member of the frame. It is positioned intermediate the two side frame members and locked into position to complete the frame assembly.

The method of frame assembly comprises locating the resilient cushions on the base member, snapping the side frame members into respective locating receptacles and interlocking flexures of the base member, thereby trapping the resilient cushions, and locking the impact platen between the two side frame members.

DESCRIPTION OF THE DRAWING

These and other features and advantages of the invention will be appreciated by those skilled in the art, from the following description of an illustrative preferred embodiment wherein reference is made to the accompanying drawing, of which.

DESCRIPTION OF THE PREFERRED EMBODIMENT

Figure 1:
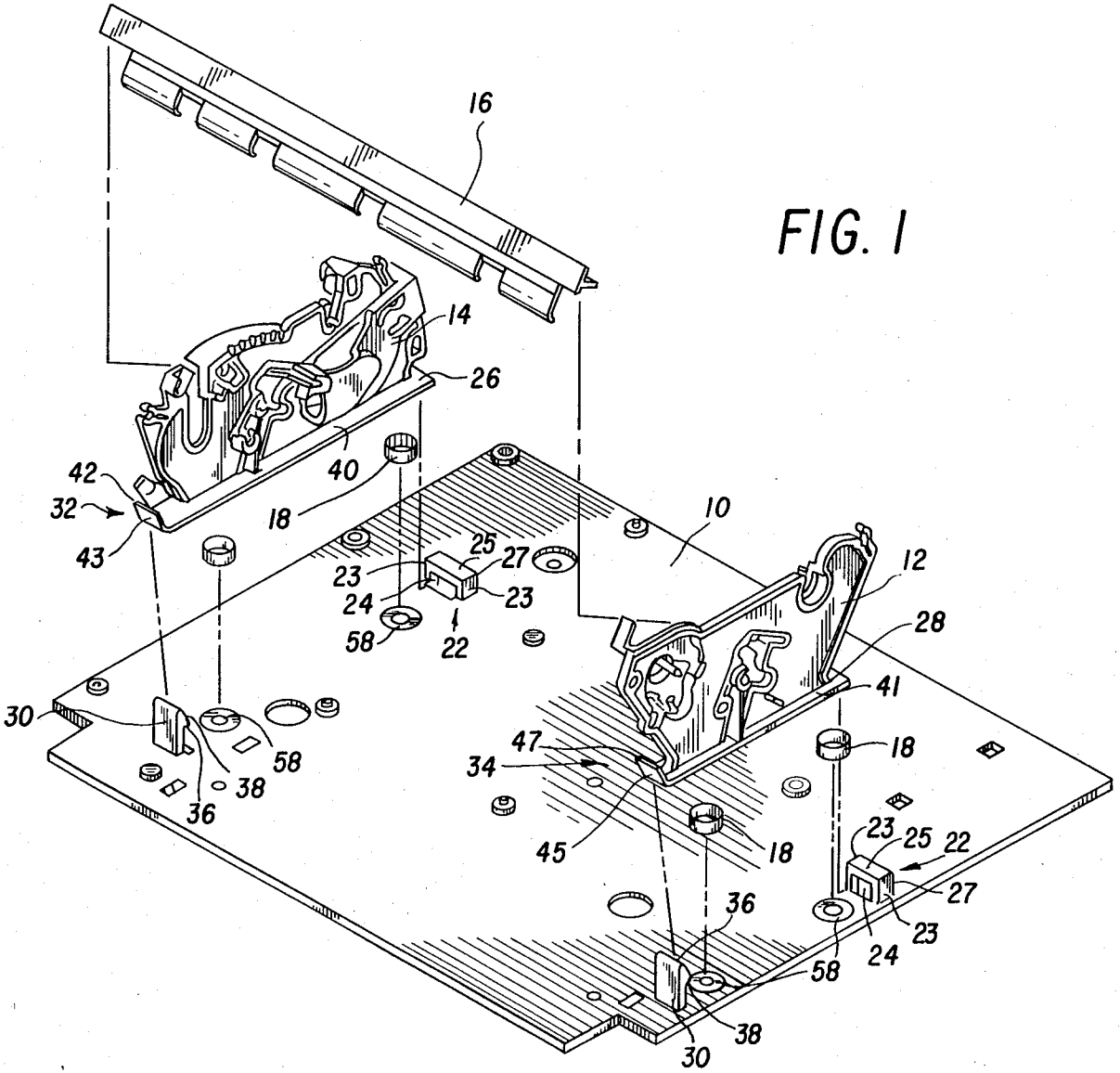
FIG. 1 is a perspective view of the printer frame assembly components prior to assembly.

Referring to FIG. 1, the printer frame assembly according to the preferred embodiment comprises a base 10, a right-side frame member 12, a left-side frame member 14, an impact platen 16 and resilient cushions 18. The base 10 serves as the foundation for the printer frame assembly, and can be fabricated from any material having the requisite strength, stiffness, workability and other physical properties necessary for this application. Foamed polycarbonate has been selected for its moldability, strength and vibration absorbing properties.

Molded onto the upper surface of the base 10 are two locating receptacles 22. Locating receptacles 22 each have two substantially parallel side walls 23, a top wall 25 and a rear wall 27 which define openings 24. Locating receptacles 22 have dimensions such that rear ends 26 and 28 of side frame members 14 and 12, respectively, are accurately positioned and restrained in both front-to-back and side-to-side directions within openings 24 during initial assembly and subsequent printer operation.

Also molded onto base 10, are interlocking flexure latches 30 which latch and secure respective front ends 32 and 34 of side frame members 14 and 12, respectively. Interlocking flexure latches 30, in the preferred embodiment, are somewhat flexible, allowing them to elastically bend during frame assembly. After assembly, the interlocking flexure latches 30 snap back to their original position and provide a front-to-back bias to maintain the side frame members 12 and 14 in proper alignment.

Figure 2A:
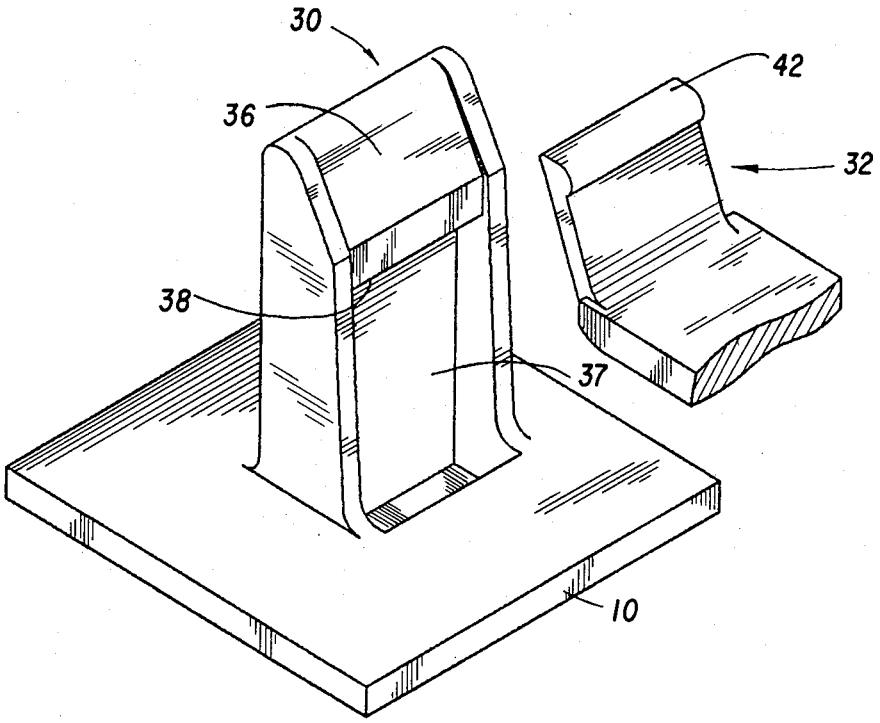
FIG. 2*a* is an enlarged rear view of a flexure latch.
Figure 2B:
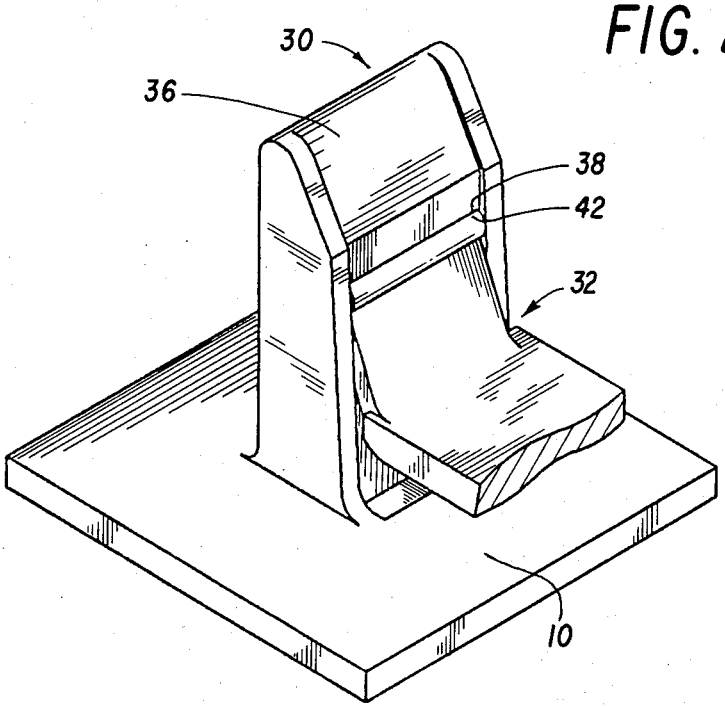
FIG. 2*b* is an enlarged view of a flexure latch following insertion of a front end of a side frame member.

As seen in FIG. 2*a*, the flexure latches 30 have angled camming surfaces 36 to facilitate assembly as more fully described with reference to FIG. 6. Flexure latches 30 additionally comprise locking surfaces 38, substantially parallel to the base 10, on the undersides of camming surfaces 36. These serve the function of latching and securing the front ends 32 and 34 of the side frame members 14 and 12, respectively. To prevent side-to-side movement of the side frame members, flexure latches 30 have channels 37 to accept and constrain the front ends 32 and 34 following insertion. FIG. 2*b* illustrates a flexure latch 30 following insertion of a front end 32.

Figure 3:
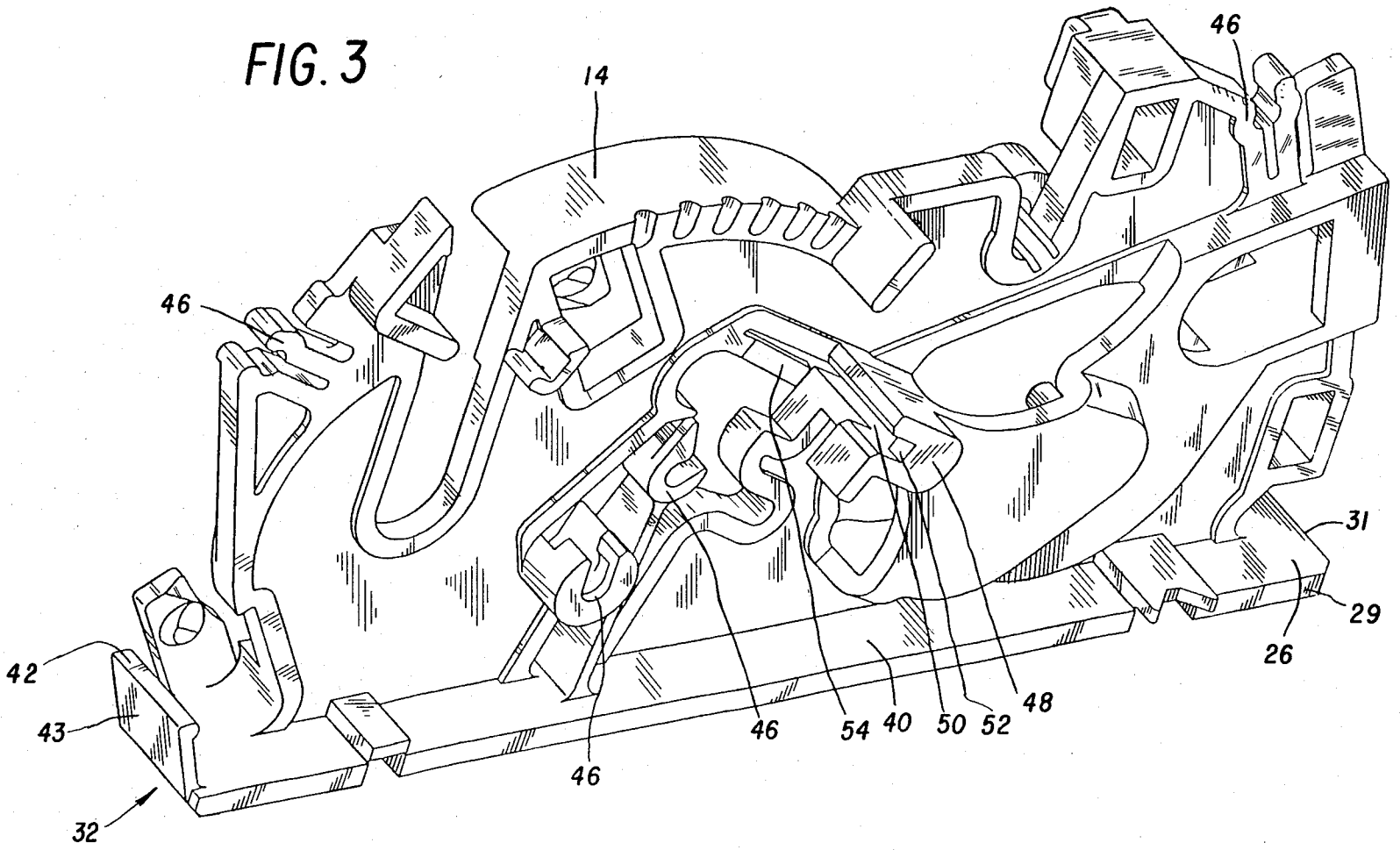
FIG. 3 is an enlarged perspective view of the inner surface of the left-side frame member.

Referring to FIG. 3, the left-side frame member 14 functions as both an integral structural member of the frame assembly and as a support for the several motors, shafts, and rollers, which comprise the actual printing and sheet feeding mechanisms. A plurality of bearings 46 are provided to secure the shafts and rollers and provide bearing surfaces as necessary. A lubricating material, such as Teflon, is incorporated into the glass-filled polycarbonate material of the side frame members to provide the bearing surface. Bottom 40 has a flat, broad surface which provides a broad base of support for the side frame member 14, contributing to the lateral stability and the transmission of forces within the printer frame. Rear end 26 and front end 32 provide the connecting fetures to base 10. Rear end 26 defined by substantially parallel sides 29 (only one of which is visible in FIG. 3) and back end 31, inserts into the opening 24 of a locking receptacle 22 on base 10. Following assembly, back end 31 abuts against rear wall 27, providing the front-to-back alignment of the side frame member 14.

The front end 32 has an angled surface 43 and a locking surface 42. It is designed to flex when inserted into a flexure latch 30 during assembly, yet remain rigid after assembly. The locking surface 42 is substantially parallel to the base 10 when the printer frame is assembled. After assembly, flexural forces, resulting from the cooperation between interlocking flexure latch 30 and front end 32, and spring forces resulting from the compressed cushions 18 maintain the locking surfaces 38 and 42 in contact with each other providing a secure connection between the components. Furthermore, the flexural forces maintain the back end 31 securely contacting the rear wall 27 which also increases the rigidity and precise alignment of the printer frame.

Figure 4:
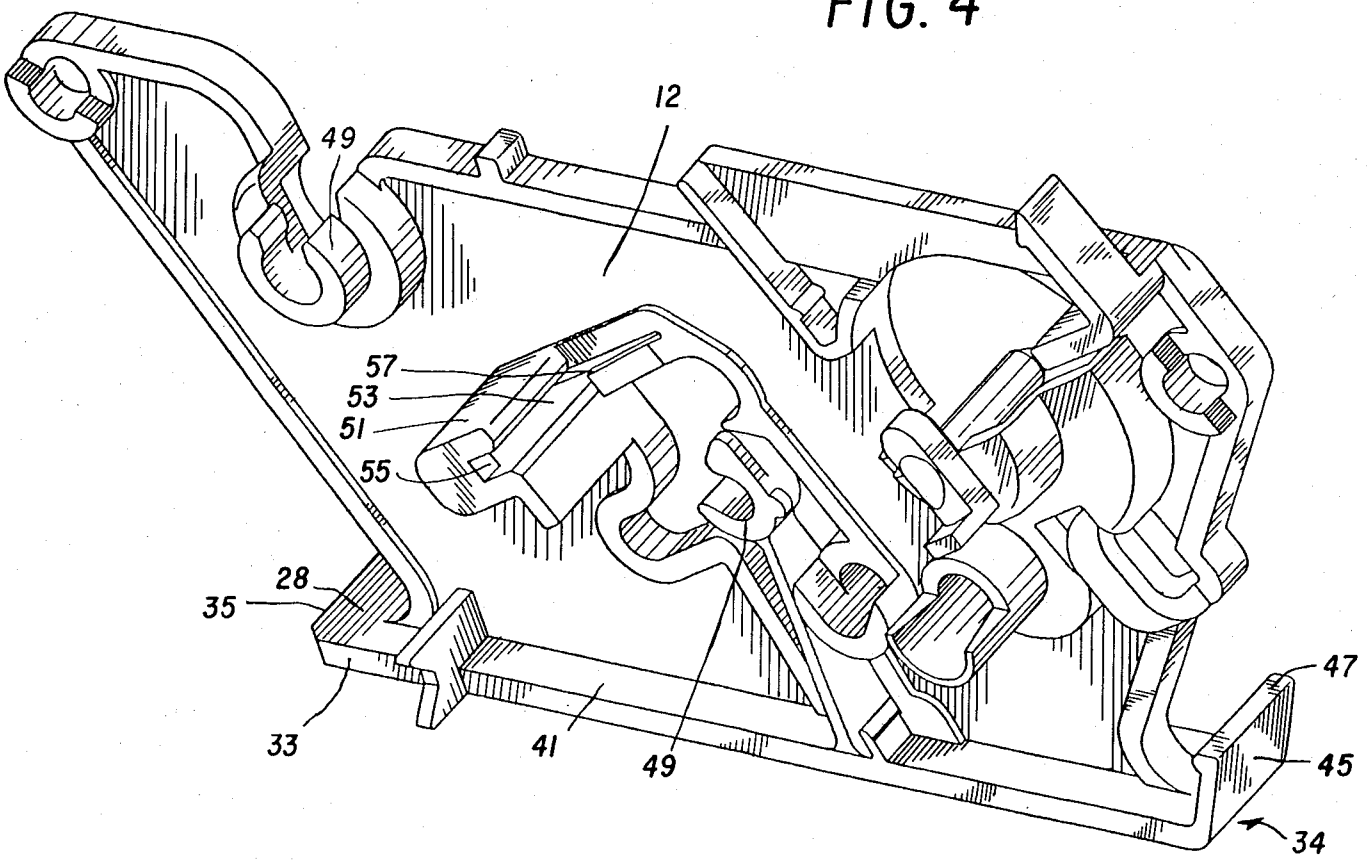
FIG. 4 is an enlarged perspective view of the inner surface of the right-side frame member.

Right-side frame member 12, enlarged in FIG. 4, is very similar in appearance to the left-side frame member 14. It has a rear end 28 defined by substantially parallel sides 33 (only one of which is visible in FIG. 4) and back end 35, and a flexible front end 34 having an angled surface 45 and locking surface 47. Additionally, it comprises integral bearings 49 for shafts and rollers.

Referring to FIGS. 3 and 4, the side frame members 12 and 14 also secure the impact platen 16 between them. To accomplish this function, they are provided with mounting fixtures 48 and 51, each having respective slots 50 and 53, and locating ribs 52 and 55. To lock the platen in place after insertion, flexible locking tabs 54 and 57 are provided. Tabs 54 and 57 flex when cammed out of the way by insertion of the impact platen. After insertion, the tabs spring back to their original position, thereby locking the platen in place.

Figure 5:
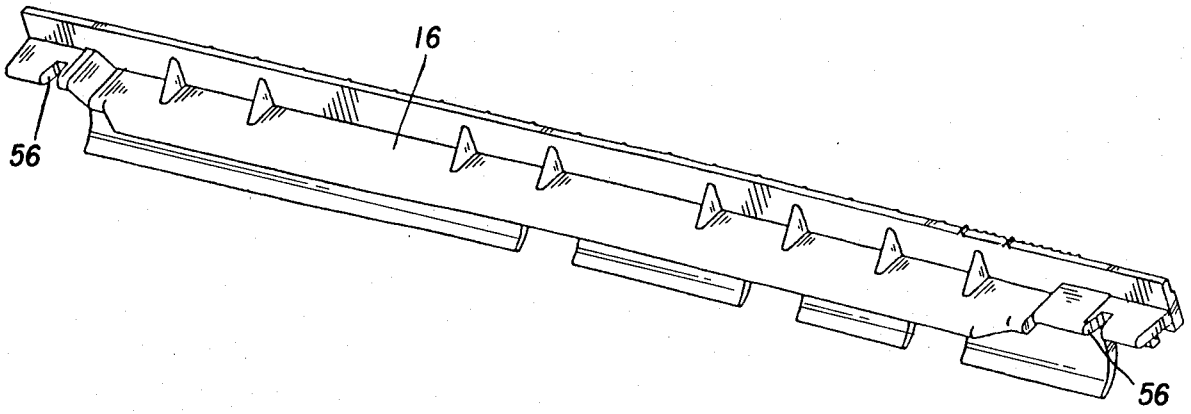
FIG. 5 is an enlarged view of the backside of the impact platen.
Figure 7:
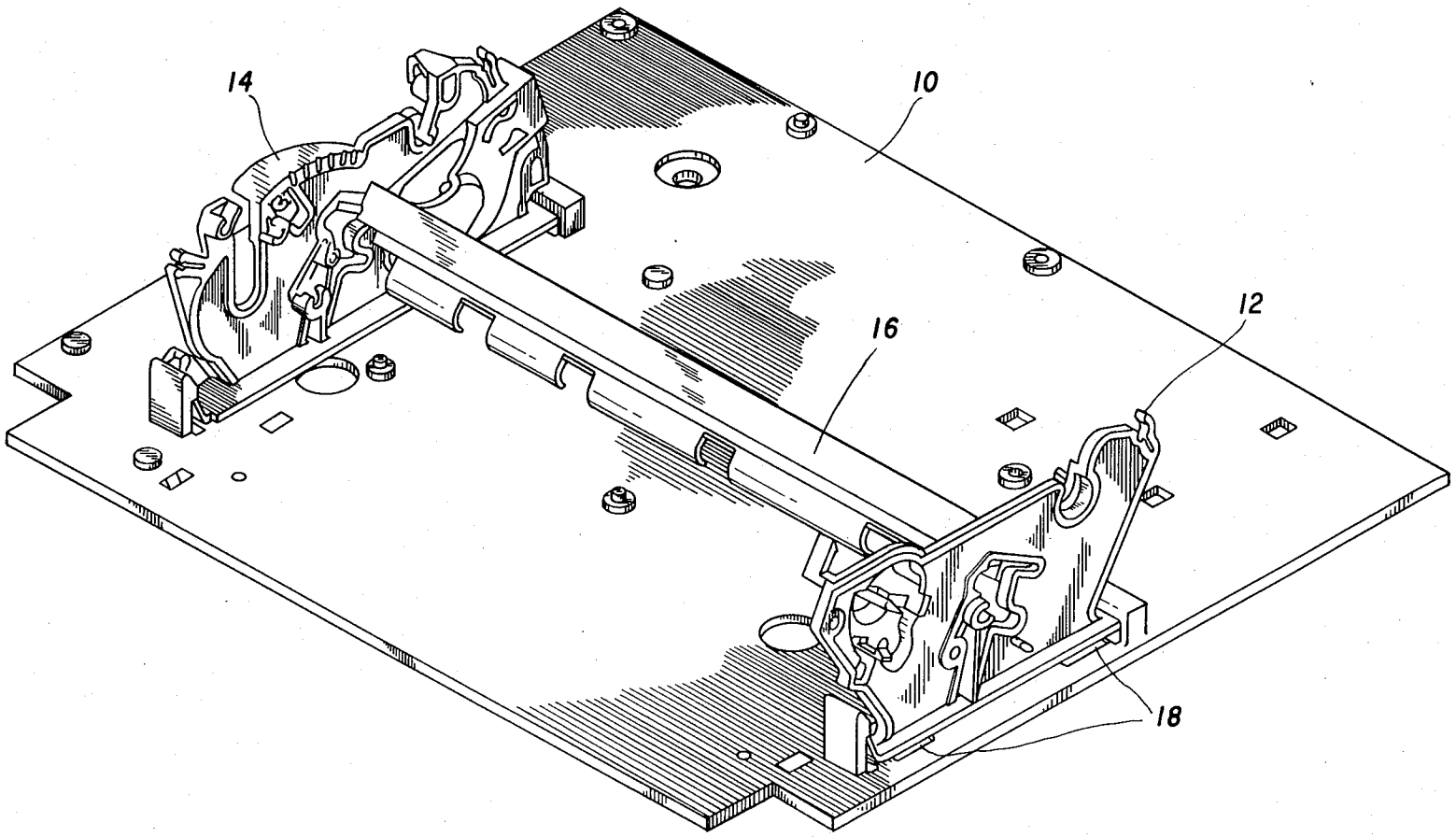
FIG. 7 is a perspective view of the assembled printer frame.

The impact platen, in addition to its function of supporting the printing medium, is a structural member of the frame. Referring to FIG. 7, it is positioned between the side frame members 12 and 14 above the base 10, completing the rigid rectangular printer frame. As shown in FIG. 5, the backside of the impact platen 16 has V-shaped grooves 56 that are used for aligning the side frame members during assembly, and rigidly maintaining their alignment after assembly. V-shaped grooves 56 straddle the locating ribs 52 and 55 of the side frame members 14 and 12 to tie the side frames into a rigid structure.

Referring once again to FIG. 1, the resilient cushions 18 serve as location urging means which urge and retain the corresponding locking surfaces 38 and 42 together, so that continuous engagement between the surfaces is obtained. These location urging means are located intermediate the bottoms 40 and 41 of the side frame members 14 and 12, respectively, and the base 10. When compressed, the resulting spring forces urges the locking surfaces 42 and 47 tightly against locking surfaces 38 to maintain a secure connection.

Figure 6A:
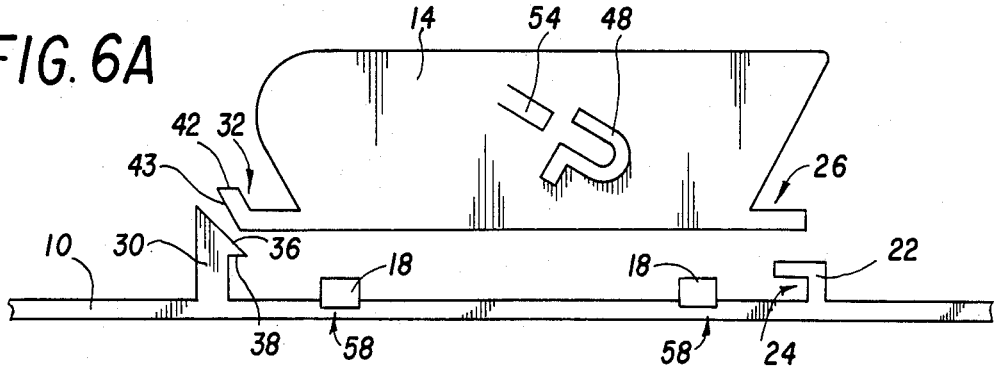
FIG. 6 is a diagrammatic view of the left-side frame member illustrating its connecting features—(a) before insertion, (b) during insertion, (c) after insertion into the base, and (d) after insertion of the platen.
Figure 6B:
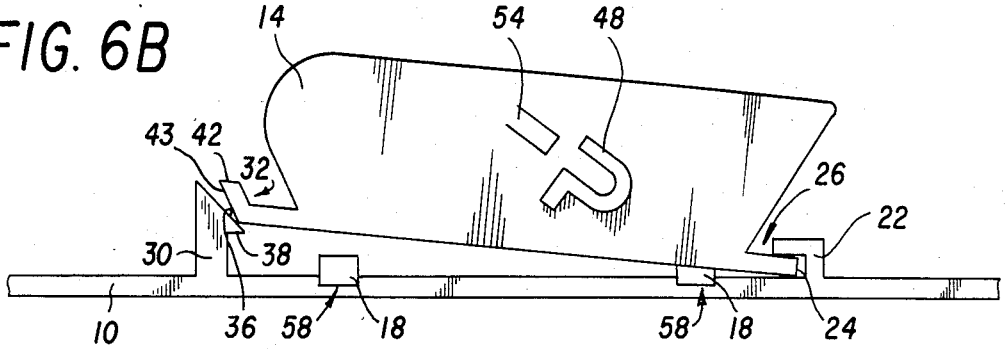
Figure 6C:
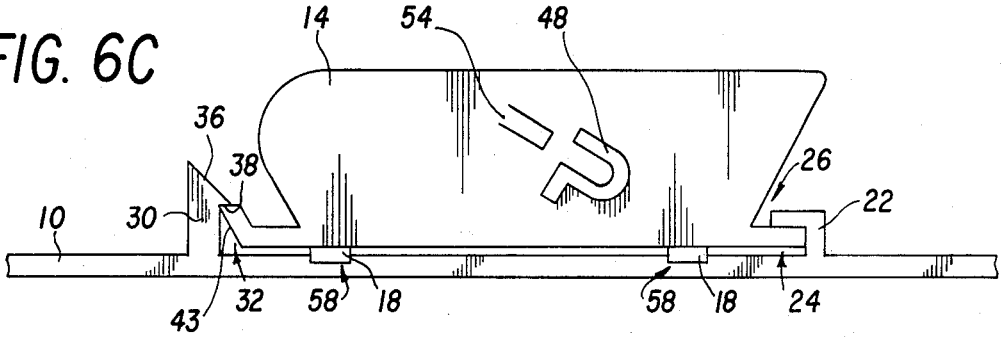

Robotic assembly of the components is possible due to the simplicity of the assembly and the absence of fasteners. For robotic assembly a base 10 having locating receptacles 22 and interlocking flexure latches 30 is placed on a support surface. FIGS. 6*a–d* diagrammatically illustrate the insertion of only the left-side frame member 14, but the right-side frame member 12 is inserted in similar fashion. The resilient cushions 18 are then placed on the base 10 at recessed locations 58 (FIG. 6*a*). The side frame members 12 and 14, in either order, are next inserted. The rear ends 26 and 28 are first placed into holes 24 as shown in FIG. 6*b*. Subsequently, a vertical force is applied to the side frame members, causing the angled surfaces 43 and 45 to slide along the camming surfaces 36 of flexure latches 30. This action flexes the flexure latches 30 and front ends 32 and 34 so that the front ends 32 and 34 can move into proper position. When locking surfaces 42 and 47 have cleared locking surfaces 38 (FIG. 6*c*), the flexure latches 30 and front ends 32 and 34 snap back to their original shapes such that locking surfaces 38, 42 and 47 coact to secure the side frame members 12 and 14 to the base 10.

Figure 6D:
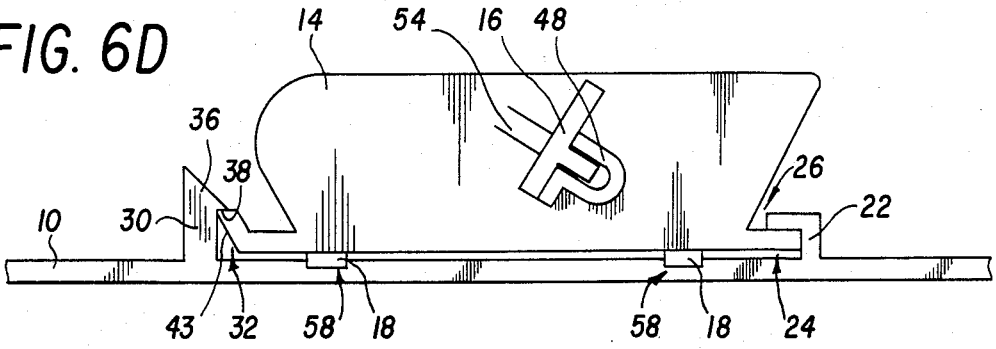

Referring to FIG. 6*d*, impact platen 16 is next inserted into respective mounting fixtures 48 and 51 such that V-shaped grooves 56 align with locating ribs 52 and 55. Flexible locking tabs 54 and 57, which have cammed out of the way during insertion spring back into their original position to secure the impact platen 16. Insertion of impact platen 16 aligns the side frame members 12 and 14 and stabilizes the entire printer frame assembly.

Figure 8:
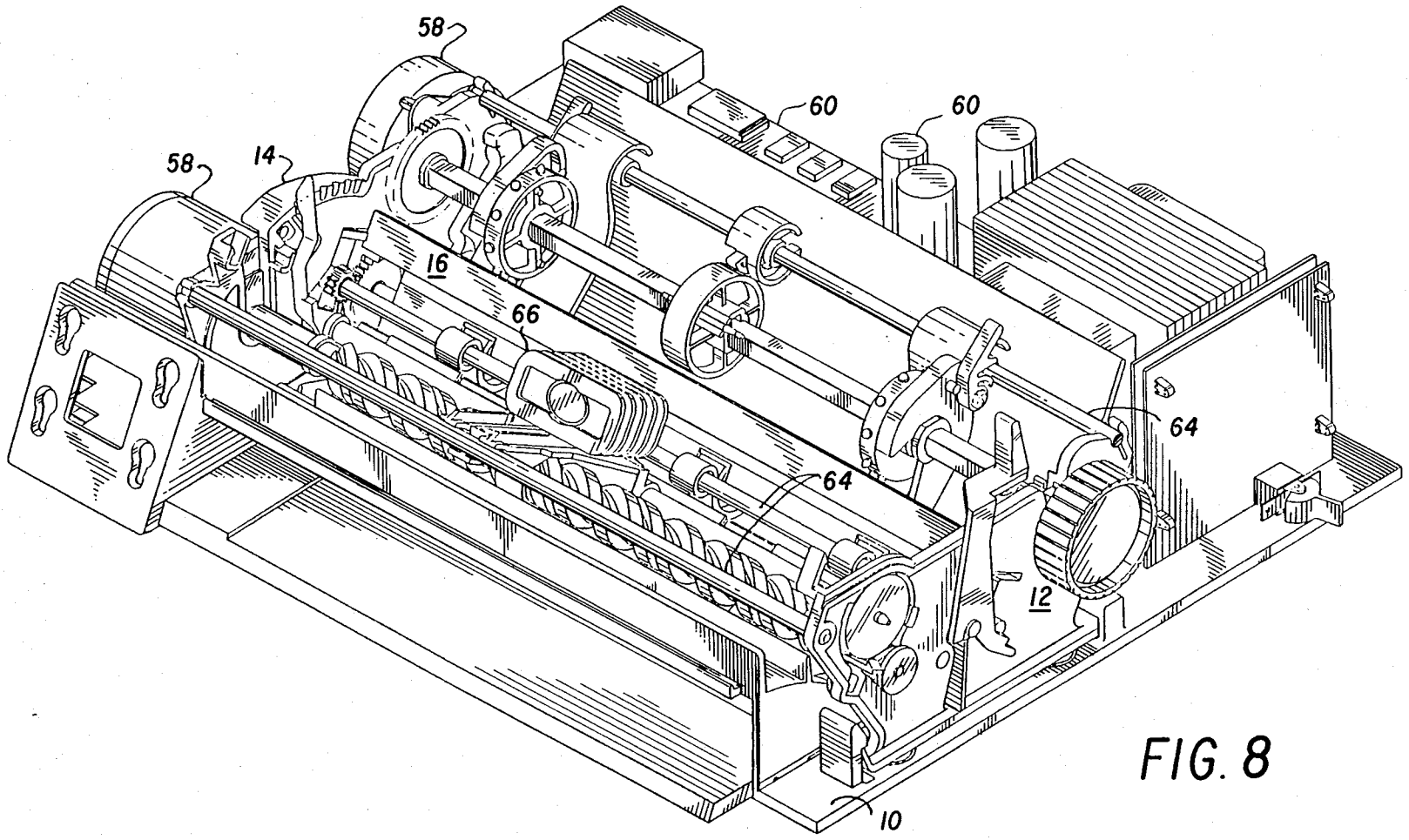
FIG. 8 is a perspective view of the assembled printer frame with printing means attached.

FIG. 7 illustrates the completed printer frame assembly and FIG. 8 illustrates the printer frame assembly with the various interrelated motors 58, electronics 60, shafts 64, and printhead 66, that comprise the printing means.

While the invention has been particularly shown and described with reference to a preferred embodiment thereof, it will be understood by those skilled in the art that various changes in detail may be made therein without departing from the spirit, scope and teaching of the invention. Accordingly, the apparatus and process herein disclosed are to be considered as merely illustrative, and the invention is to be limited only as specified in the claims.

We claim:

1. A printer frame assembly comprising:

a base member having first and second flexure latches;

said flexure latches each having a locking surface included therein;

first and second side frame members each having a front end and a rear end including locking surfaces at the front end of each said side frame member for engaging said locking surfaces of said flexure latches to latch and secure said side frame members to said base members;

resilient location urging means positioned between said base member and each of said side frame members, urging and maintaining each of said front locking surfaces into secure engagement with said locking surfaces of said flexure latches;

first and second locating receptacles, having at least a top wall and rear wall, each one adapted to receive, position and secure the rear end of each of said side frame members;

said flexure latches and said front lock means of said side members, each including complementary angled surfaces which allow said side frame members to be press fit into the position of secure engagement with said base member by restricting movement of said side frame members by the co-action between said locating receptacles and said flexure latches;

the distance from the rear end of each of said side frame members to the extremity of said angled surface of said respective side frame member being greater than the distance between the rear wall of said locating receptacle and the locking surface of said flexure latch, creating a front to back flexural force between each said flexure latch and the respective front end of said side frame member, urging and maintaining each said side frame member against the rear wall of the respective said locating receptacle, increasing the rigidity and precise alignment of the printer frame.

2. The printer frame assembly according to claim 1 further comprising a platen rigidly connected intermediate said first and second side frame members.

3. The printer frame assembly according to claim 2 wherein said first and said second flexure latches of said base member each comprise a latch projecting from said base member, said latch having a camming surface to co-act with respective front locking surfaces of said side frame members, whereby said camming surface can guide said front locking surfaces into proper alignment under said locking surface of said flexure latch.

4. The printer frame assembly according to claim 3 wherein said flexure latch further comprises a first locking surface being substantially parallel to said base member, whereby said first locking surface securely engages said front locking surfaces of said first and second side frame members.

5. The printer frame assembly according to claim 4 wherein each of said front ends of said first and said second side frame members comprises:

an angled surface to slidably co-act with said camming surface of said flexure latch to guide said front end and said flexure latch into a position of secure engagement; and a locking surface located at the top of said first surface and substantially parallel to said base member.

6. The printer frame assembly according to claim 5 wherein each of said flexure latches further comprises channels to prevent lateral displacement of the front ends of said side frame members.

* * * * *